United States Patent [19]

Wichart

[11] Patent Number: 4,714,057

[45] Date of Patent: Dec. 22, 1987

[54] VARIABLE VALVE CONTROL SYSTEM FOR A PISTON INTERNAL-COMBUSTION ENGINE

[75] Inventor: Klaus Wichart, Vienna, Austria

[73] Assignee: Dr. Ing. h.c.F. Porsche Aktiengesellschaft, Weissach, Fed. Rep. of Germany

[21] Appl. No.: 868,711

[22] Filed: May 30, 1986

[30] Foreign Application Priority Data

May 30, 1985 [DE] Fed. Rep. of Germany ..... 3519319

[51] Int. Cl.[4] ..... F01L 1/34

[52] U.S. Cl. ..... 123/90.15; 123/90.27; 123/90.44

[58] Field of Search ..... 123/90.15, 90.16, 90.17, 123/90.27, 90.41, 90.44, 90.52, 90.55

[56] References Cited

U.S. PATENT DOCUMENTS

| | | | |
|---|---|---|---|
| 2,021,333 | 11/1935 | Storey | 123/90.46 |
| 2,065,081 | 12/1936 | Lee | 123/90.12 |
| 3,463,131 | 8/1969 | Dolby | 123/90.44 |
| 3,610,218 | 10/1971 | Durham | 123/90.41 |
| 3,817,228 | 6/1974 | Bywater | 123/90.16 |
| 3,995,606 | 12/1976 | Firey | 123/90.16 |
| 4,452,187 | 6/1984 | Kosuda et al. | 123/90.16 |
| 4,506,635 | 3/1985 | van Rinsum | 123/90.4 |
| 4,526,142 | 7/1985 | Hara et al. | 123/90.46 |
| 4,530,318 | 7/1985 | Semple | 123/90.27 |

FOREIGN PATENT DOCUMENTS

| | | | |
|---|---|---|---|
| 3014005 | 10/1980 | Fed. Rep. of Germany . | |
| 152308 | 1/1980 | Japan | 123/90.16 |
| 0148910 | 11/1980 | Japan | 123/90.16 |
| 0195809 | 12/1982 | Japan | 123/90.16 |
| 020910 | 11/1984 | Japan | 123/90.16 |

*Primary Examiner*—Craig R. Feinberg
*Assistant Examiner*—David A. Okonsky
*Attorney, Agent, or Firm*—Barnes & Thornburg

[57] ABSTRACT

In a variable valve control system for an internal-combustion engine, having an intake valve actuated by a valve lever that can be pivoted around a shiftable bearing point, a lift camshaft and a control camshaft are provided. The camshafts control the pivoting of the valve lever. The system also includes a device for phase-shifting the control camshaft relative to the lift camshaft in response to operating parameters of the internal-combustion engine. This provides for premature closing of the intake valve.

13 Claims, 8 Drawing Figures

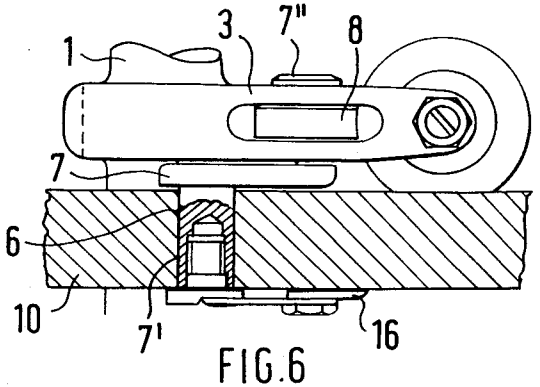
FIG.6
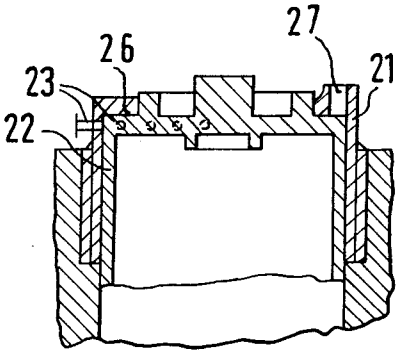
FIG.8
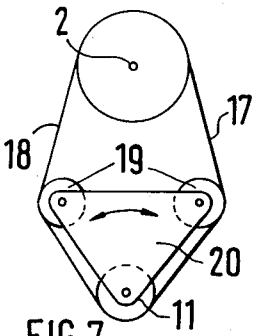
FIG.7
FIG.5
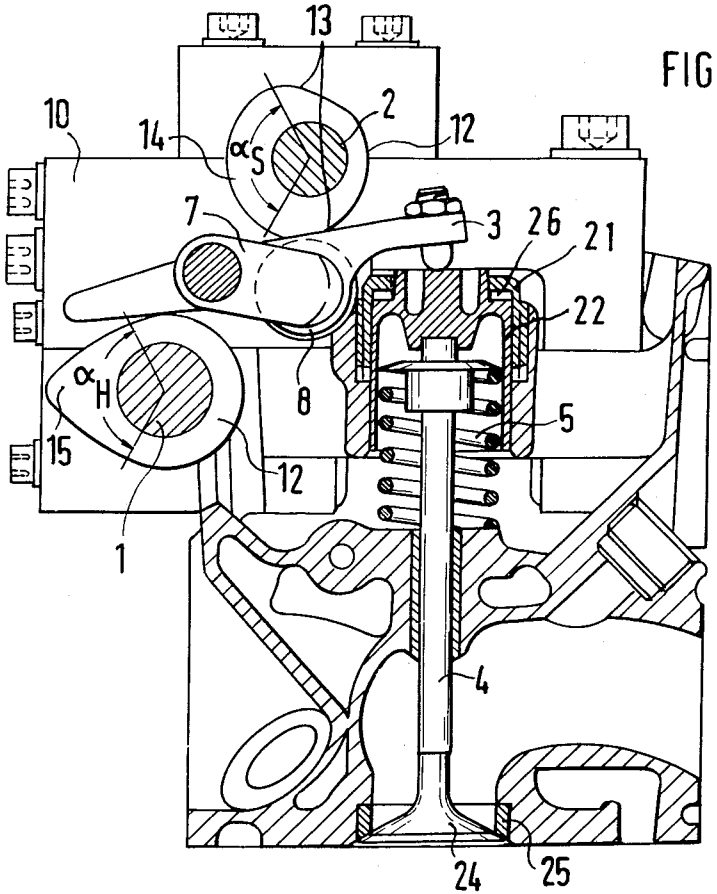

VARIABLE VALVE CONTROL SYSTEM FOR A PISTON INTERNAL-COMBUSTION ENGINE

BACKGROUND AND SUMMARY OF THE INVENTION

An example of a variable valve control system is described in DE-OS No. 30 14 005 in which the actuating mechanism has a lift camshaft driven by the crankshaft. The lift camshaft, through a two-armed pivotable valve lever and a second cam that can be phase-rotated with respect to the lift camshaft, affects an intake valve of an internal-combustion engine. In order to make the valve lift curve of the intake valve changeable as a function of the operating conditions of the internal-combustion engine, the bearing shaft of the valve lever can be shifted relative to the axes of the lift camshaft and of the second cam which has an eccentric. Also, the angular position of the second cam relative to the lift camshaft can be controlled as a function of the load and the speed of the internal-combustion engine. By means of these two adjusting devices, an improvement of the efficiency of the internal-combustion engine for a partial engine load is achieved by changing the valve lift and the valve opening time. The disadvantages of this type of valve control system, however, is its high expense.

It is an objective of the present invention to provide a variable valve control system that can be manufactured at low cost and that changes the valve lift curve such that charge changing losses caused by the throttling are avoided without requiring a change of other adjusting quantities of the internal-combustion engine.

When a control camshaft rotating at the same speed is applied to the valve lever in addition to the lift camshaft, with the control camshaft affecting the pivoting motion of the valve lever, the intake valve can follow the same opening curve, while the charge volume is reduced only by the premature closing of the intake valve for all lift adjustments. The overlapping angle from the discharge valve to the intake valve maintains the same size for all valve lift curves that are adjusted in this way. By shortening the time cross-section, the charge volume is reduced without the occurrence of throttling and charge changing losses. In addition, by closing the intake valve as a function of the speed, a rise of torque is possible for maximum load conditions.

A feature of a preferred embodiment of the present invention is the disposition of the valve lever on a crank that can be pivoted at a stationary bearing point of the cylinder head. In contrast to conventional valve control systems, where the valve lever is pivoted around a stationary bolt, the valve lever according to the invention has an additional degree of freedom because it can be pivoted around two axes at the same time.

A further feature of a preferred embodiment is a roller disposed on the crank that is affected by the rotating control camshaft. On its cam, the control camshaft has a circular segment, the angular course of which is identical to the angular course of the cam of the lift camshaft. When the relative positions of the lift camshaft and the control camshaft are adjusted such that over the whole angular course of the lift camshaft, the circular segment of the control camshaft is also applied to the valve lever, the valve lever will carry out a pivoting motion as if it were disposed at a stationary bolt in the conventional way.

When the control camshaft is now rotated with respect to the lift camshaft, the valve lever, when the lift cam is arrested, can travel in the direction of the base circle of the control cam so that the intake valve is not completely opened and is closed again prematurely. Because the opening time is reduced in this way, the charge volume supplied to the cylinder is reduced. In addition, in the lower partial-load range, a desirable increased charging motion takes place. Because of the unthrottled intake and the higher pressure in front of the intake valve, the exhaust residual share is reduced, thereby improving combustion and efficiency.

Further objects, features, and advantages of the present invention will become more apparent from the following description when taken with the accompanying drawings which show, for purposes of illustration only, embodiments constructed in accordance with the present invention.

BRIEF DESCRIPTION OF THE DRAWINGS

FIG. 5 is a partial sectional view of the valve control system of FIG. 1 illustrated in a cylinder head of an internal-combustion engine;

FIG. 6 is a partial top view of the valve control system of FIG. 5;

FIG. 7 shows a preferred embodiment of an adjustable drive of the control camshaft; and FIG. 8 shows a preferred embodiment of a hydraulic damping device.

DETAILED DESCRIPTION OF THE DRAWINGS

Figure 1:
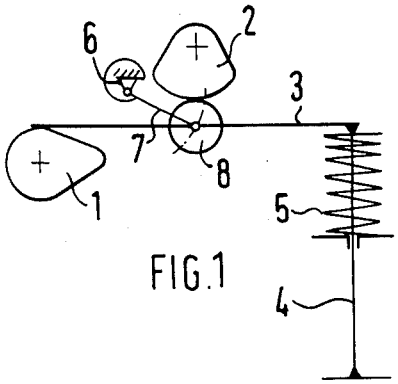
FIG. 1 is a schematic view of a valve control system constructed in accordance with a preferred embodiment of the present invention.

The valve control system as shown in FIGS. 1 and 6 has a lift camshaft 1 and a control camshaft 2 that are both applied to a rocker lever 3 that actuates an intake valve 4 against the force of a valve spring 5. A pin 7' of a crank 7 is disposed at a stationary bearing point 6 of the internal-combustion engine. The rocker lever 3 as well as a roller 8 are disposed on another pin 7''. The rocker lever 3 and the roller 8 are affected by the control camshaft 2.

Figure 2:
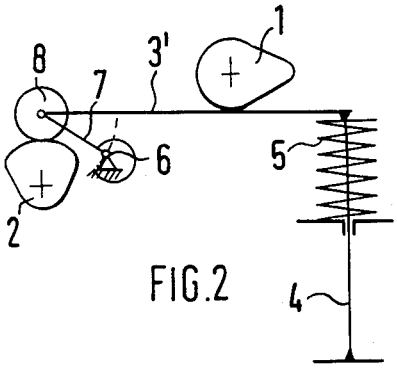
FIG. 2 is a schematic view of a valve control system constructed in accordance with a second preferred embodiment of the present invention.

In the embodiment of the valve control system illustrated in FIG. 2, a one-armed valve lever 3' is used as the valve lever. On one of its ends it is pivotably connected to the crank 7. At this connection point, the lever 3' can be actuated by the control camshaft 2 through the roller 8, while the lift camshaft 1 is applied to the valve lever 3' approximately in the center.

Figure 3:
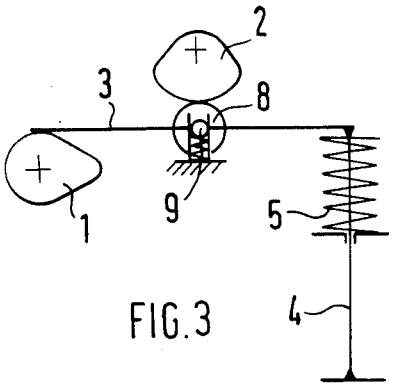
FIG. 3 is a schematic view of a valve control system constructed in accordance with a third preferred embodiment of the present invention.

In the embodiment of FIG. 3, as in the embodiment of FIG. 1, a two-armed rigid rocker lever 3 is used as the valve lever. However, in FIG. 3, this valve lever is disposed on a spring-elastic bearing journal 9 which, through the roller 8 fitted onto it, can be shifted by the control camshaft 2.

FIGS. 5, 6 and 7 show in more detail the construction of a valve control system corresponding to the schematic embodiment of FIG. 1. The lift camshaft 1 and the control camshaft 2 are rotatably disposed in the cylinder head 10, are driven by the crankshaft 11 and rotate at the same speed. The control camshaft 2 and the lift camshaft 1 are applied to the rocker lever 3 disposed on the crank 7. One arm of the rocker lever 3 rests on the base circle 12 of the lift camshaft 1, whereas the roller 8 that is disposed on the crank pin 7" (FIG. 6) has no contact yet with the control camshaft 2. The intake valve 4 is still closed at this point.

When the lift camshaft 1 turns clockwise, the rocker lever 3 is pivoted around the pin 7" of the crank 7 corresponding to the evaluation 15 of the cam. At the same time, the control camshaft 2 is rotating counterclockwise. The roller 8 now contacts the transition area 13 to the circular segment 14. The intake valve 4 is opened and with the decreasing elevation 15 of the cam is closed again by the force of the valve spring 5. In the illustrated relative rotating positions of the lift camshaft 1 and the control camshaft 2, the roller 8, through the whole angular path $\alpha_H$ of the lift camshaft 1, remains in contact with the circular segment 14 of the control camshaft 2. This is because the angular path $\alpha_S$ of the circular segment 14 has the same magnitude as the angular path $\alpha_H$ of the cam elevation 15 of the lift camshaft 1. The opening and closing of the valve 4 for this configuration is described by the valve lift curve h1 shown in FIG. 4.

Figure 4:
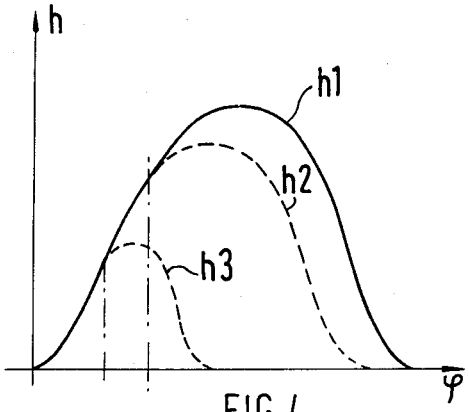
FIG. 4 illustrates valve lift curves of a preferred embodiment of the present invention.

When the relative rotating position of the control camshaft 2 with respect to the lift camshaft 1 is changed, by means of the adjusting device shown in FIG. 7 and described more fully below, the roller 8, during the evaluation portion of the curve, leaves the angular range $\alpha_S$ of the circular segment 14. This causes the crank 7 to pivot around the stationary bearing point 6 and the intake valve 4 to close prematurely. This provides the lift curve h2 that is shown in FIG. 4.

By further adjusting the relative rotating position of the camshafts 1, 2, a curve h3 can be attained that has a time cross-section which is further reduced. The curves h1, h2, h3 plot height of the intake valve versus the angle of lift camshift. Because the angle of the lift camshaft is directly related to time, the curves represent the height of the intake valve versus time. Alternatively, the intake valve can be stopped completely, so that a switching-off of the valve can be achieved. The opening motion of the intake valve 4 will take place on the same rising portion of the valve lift curve with a constant phase position so that the overlapping angle to the discharge valve is the same for all valve lift curves that can be achieved by means of the variable valve control.

The control camshaft 2 will be in contact with the roller 8 only as long as the intake valve 4 is opened. In order to obtain a clear position of the rocker lever 3 with respect to the lift camshaft 1 and the intake valve 4, the crank 7 and thus the rocker lever 3 is pressed down by a slightly prestressed spring 16.

In order to change the relative rotating position of the control camshaft 2 with respect to the lift camshaft 1, as described above, a toothed belt drive shown in FIG. 7 can be used between the crankshaft 11 and the control camshaft 2. In the illustrated embodiment, tightening rollers 19 rest against the load end 17 and the slack end 18 respectively of the toothed belt. A triangular carrier 20 holds the rollers 19 and the crankshaft 11. When the triangular carrier 20 is swiveled around the axis of the crankshaft 11, the load end 17 and the slack end 18 are lengthened and shortened so that the phase position of the control camshaft 2 with respect to the crankshaft 11, and therefore, also to the lift camshaft 1 driven by the crankshaft 11, is changed.

A damping device that is shown enlarged in FIG. 8 has an oil-filled hydraulic cylinder 21 that is fastened in the cylinder head 10 of the internal-combustion engine and a hollow hydraulic piston 22 guided in it. The flow of force goes from the rocker lever 3, through the hydraulic piston 22, to the valve stem of the intake valve 4. when the intake valve 4 is closed by the valve spring 5, starting at a certain closed position, oil discharge bores 23 of the hydraulic cylinder 21 are closed by the hydraulic piston 22 so that the placing of the valve disk 24 onto the valve seat 25 is delayed and very damped.

An oil pipe 27 leads to the oil space 26 located between the hydraulic cylinder 21 and the hydraulic piston 22. The oil pipe 27 is closable by means of a return valve. In addition, in a contemplated embodiment, the oil discharge bores 23 can be closed on the outside by a valve (not shown) that can be controlled as a function of parameters of the internal-combustion engine in order to make the dampening adjustable.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A variable valve control system including an internal-combustion engine, having an intake valve operable by valve lever means that can be pivoted around a shiftable bearing point, said system including:

continuously rotating lift camshaft means and continuously rotating control camshaft means for controlling the pivoting of the valve lever means;

phase-shifting means for phase-shifting the control camshaft means with respect to the lift camshaft means in response to operating parameters of the engine; and a crank pivotably arranged at a stationary bearing point, wherein said valve lever means, is disposed on said crank;

wherein said control camshaft means rotates at the same speed as the lift camshaft means; and wherein said valve lever means is pivoted against the force of valve spring means.

2. A valve control system according to claim 1, wherein the valve lever means is a two-armed rocker lever.

3. A valve control system according to claim 1, wherein the valve lever means is a one-armed valve lever.

4. A valve control system according to claim 1, further including a roller disposed on the crank, wherein said roller is interactable with the control camshaft means.

5. A valve control system according to claim 1, wherein additional spring means is biased against the pivoting motion of the crank.

6. A valve control system according to claim 1, wherein the control camshaft means has a cam having a circular segment, a base circle, and transition areas on both sides of said circular segment between the base circle and the circular segment.

7. A valve control system according to claim 6, wherein the lift camshaft means has a cam elevation with an angular range equal to the angular range of the circular segment of the control camshaft means.

8. A valve control system according to claim 1, wherein said intake valve includes a valve disk and a valve seat, said system further including hydraulic damping means mounted about the intake valve, for delaying the placing of the valve disk onto the valve seat.

9. A valve control system according to claim 8, wherein the damping force of said hydraulic damping means is adjustable.

10. A valve control system according to claim 8, wherein said damping means has an oil-filled hydraulic cylinder and a hydraulic piston guided in said cylinder, and wherein said hydraulic piston is moved by spring force by a valve stem during the closing of the intake valve.

11. A valve control system according to claim 10, wherein said hydraulic cylinder includes oil discharge bores which are closed by said hydraulic piston in certain positions of the intake valve.

12. A valve control system according to claim 10, further including an oil pipe connected to the hydraulic damping means.

13. A valve control system according to claim 12, further including flow control means for controlling oil flow through the oil pipe and oil discharge bores in response to operating parameters of the internal-combustion engine.

* * * * *